United States Patent [19]

Jes

[11] Patent Number: 4,497,408

[45] Date of Patent: Feb. 5, 1985

[54] STACKABLE CONTAINER WITH LOCKING LID

[75] Inventor: Otto J. Jes, Long Beach, Calif.

[73] Assignee: Willamette Industries, Inc., Portland, Oreg.

[21] Appl. No.: 445,362

[22] Filed: Nov. 29, 1982

[51] Int. Cl.[3] ..... B65D 5/34; B65D 55/00

[52] U.S. Cl. ..... 206/509; 229/23 R; 229/34 R; 229/45 R; 229/DIG. 11

[58] Field of Search ..... 206/509; 229/6 A, 34 R, 229/DIG. 11, 45, 23 R

[56] References Cited

U.S. PATENT DOCUMENTS

| | | | |
|---|---|---|---|
| 3,713,579 | 1/1973 | Chaffers | 229/DIG. 11 X |
| 3,820,706 | 6/1974 | Gibson et al. | 206/509 X |
| 4,058,249 | 11/1977 | Buck | 229/DIG. 11 X |
| 4,245,773 | 1/1981 | Stollberg | 229/DIG. 11 X |
| 4,291,830 | 9/1981 | Sorensen | 229/DIG. 11 X |
| 4,304,351 | 12/1981 | Stollberg | 229/45 R X |

*Primary Examiner*—Steven M. Pollard
*Attorney, Agent, or Firm*—Eugene D. Farley

[57] ABSTRACT

A stackable container with locking lid especially suitable for use in packaging grapes and other soft fruits comprises a container body having a lid of resiliently deformable material hinged to one side wall and a ledge on an adjacent end wall. The lid rests on the ledge. A stacking cleat on said adjacent end wall extends to a plane above the lid. A recess in the inner face of the stacking cleat is coplanar with the lid. A laterally-extending locking tongue extension of the lid coplanar with the recess is dimensioned for removable insertion into the recess upon closing the lid, thereby releasably locking the lid to the cleat.

3 Claims, 5 Drawing Figures

STACKABLE CONTAINER WITH LOCKING LID

BACKGROUND OF THE INVENTION

1. Field of the Invention

The present invention relates to containers, particularly to stackable containers made from corrugated container board and having locking lids, such as are employed in the packaging of grapes and other soft fruits.

2. Description of the Prior Art

Prior U.S. patents of interest in connection with the presently described container are the following, considered together with the references cited therein:

| U.S. Pat. No. | Patentee | Issue Date |
|---|---|---|
| 3,713,579 | Chaffers | January 30, 1973 |
| 3,820,706 | Gibson et al | June 28, 1974 |
| 4,245,773 | Stollberg | January 20, 1982 |
| 4,291,830 | Sorensen | September 29, 1981 |
| 4,304,351 | Stollberg | December 8, 1981 |
| 4,303,353 | Stollberg | December 8, 1981 |

Of the foregoing, Chaffers U.S. Pat. No. 4,713,579 is of the greatest interest with respect to my presently described invention.

In the stackable container disclosed in the Chaffers patent, the stacking cleat extends above the plane of the lid. Its inner face is provided with a relief which also is located above the plane of the lid.

A mating, upwardly extending locking tab carried by the lid snaps into place in the relief when the lid is closed. This requires that the locking tab be bent substantially at right angles to the lid and that it remain in this deformed, upwardly extending position when the lid is closed.

It follows, therefore, that when the lid is opened, the opening forces a thrusting action against the locking tab in the plane of the tab, which usually is formed from corrugated paperboard. As a result, after one or two cycles of lid locking and unlocking, the tab delaminates, becomes dog-eared, and is no longer able to perform its locking function efficiently. Accordingly it is not possible to lock and unlock the lid of the container repeatedly, as is required during routine operations as the container contents are repeatedly inspected, dispensed, and stored.

Also, in the Chaffers container the lid is in two sections, and there are two spaced stacking cleats with associated locking means, one for each lid section. As a result, it is comparatively difficult and time consuming to stack the containers, since the spaced cleats must be precisely aligned each time one container is stacked upon the subjacent container.

SUMMARY OF THE INVENTION

The present invention has for its objects the provision of a stackable container suitable for use particularly in the packaging of grapes and other soft fruits, which is simple and sturdy in construction, easily stackable without requiring precise alignment of spaced component stacking cleats, which is provided with lid-locking means which function to lock the lid securely in its closed position and to permit easy opening of the lid when such is desired, and which enable repeated opening and closing of the lid over many cycles of operation without impairment of the locking function.

The foregoing and other objects of the invention are accomplished by the provision of a stackable container comprising a container body having a lid of resiliently deformable material hinged to one side wall and a ledge on an adjacent end wall. The lid rests on the ledge. A stacking cleat on said adjacent end wall extends to a plane above the lid. A recess in the inner face of the stacking cleat is coplanar with the lid. A laterally-extending locking tongue extension of the lid coplanar therewith, is dimensioned for removable insertion into the recess upon closing the lid, thereby releasably locking the lid to the cleat.

BRIEF DESCRIPTION OF THE DRAWINGS

In the drawings:

Referring to FIG. 1:

Figure 1:
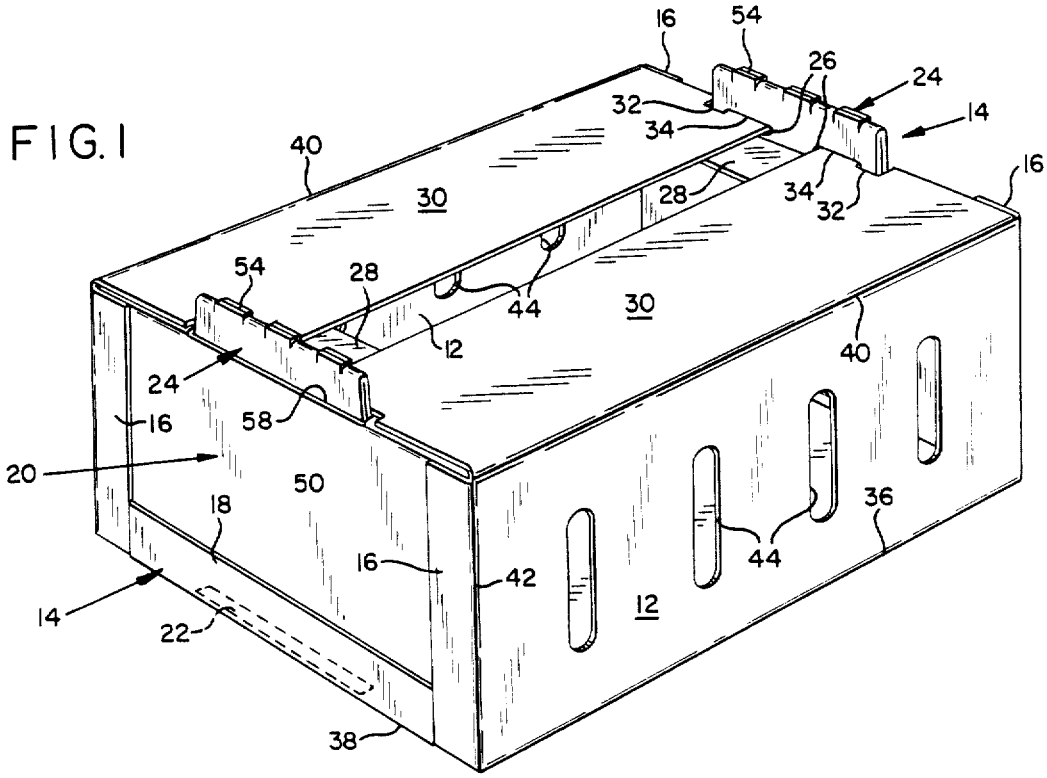
FIG. 1 is a perspective view of the stackable container with locking lid of my invention, with the lid in closed and locked position.

The container of my invention broadly comprises a body comprising a bottom 10, a pair of opposed side walls 12, and a pair of opposed end walls 14. To achieve a sturdy construction and to provide for stacking, the end walls 14 are composite in construction, being formed from side flanges 16 and bottom flanges 18 adherently united to folded center panels 20. The structure of each end wall 14 is such as to provide a stacking recess 22 on the bottom and a mating stacking cleat 24 on the top. Both cleats are centrally located and of substantial extent. The inner faces of the cleats are provided with locking recesses 26. Formed integrally with folded center panel 20 are inwardly extending ledges 28, which preferably comprise folded segments of center panels 20.

Hinged to side wall 12 of the carton body are a pair of lids 30. The end margins of the lids are formed with reliefs 32, to accommodate stacking cleats 24, and with laterally extending, locking tongue extensions 34 dimensioned for removable insertion into locking recesses 26 in the cleats upon closing the lids. Lids 30 preferably are dimensioned to leave a central gap for purposes of ventilation and inspection, as is apparent from FIG. 1.

Inwardly folded ledges 28 are positioned slightly below the upper edges of the end walls 14 and are adapted to support lids 30, which are substantially coplanar with the locking recesses 26 on the inner faces of the cleats. As a result, integral locking tongues 34 also are substantially coplanar with the locking recesses, a factor which is responsible for the improved operation of the container of my invention, as will appear hereinafter.

Figure 5:
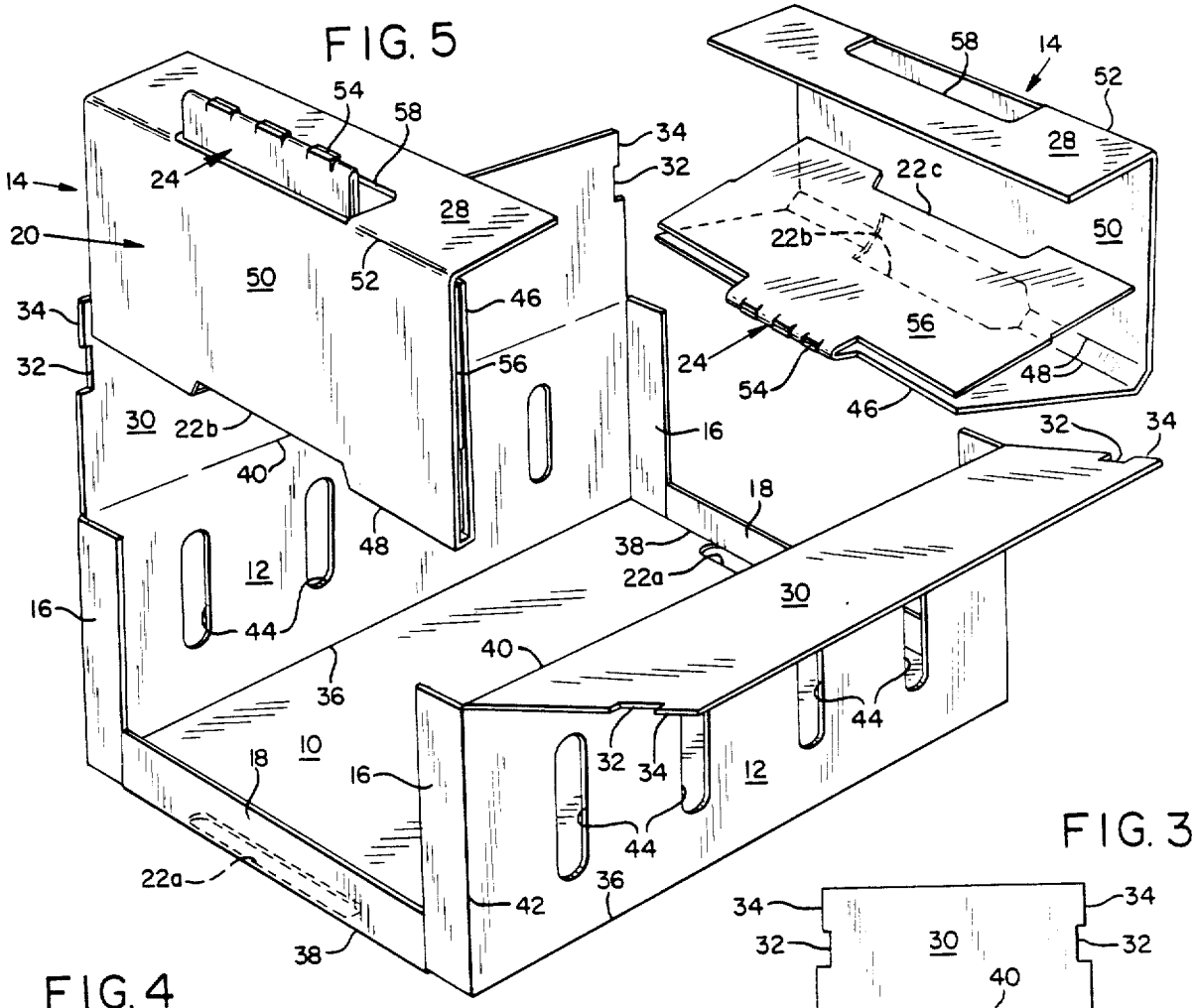
FIG. 5 is an exploded perspective view of the container showing details of one partially formed end wall and one fully formed end wall.
Figure 3:
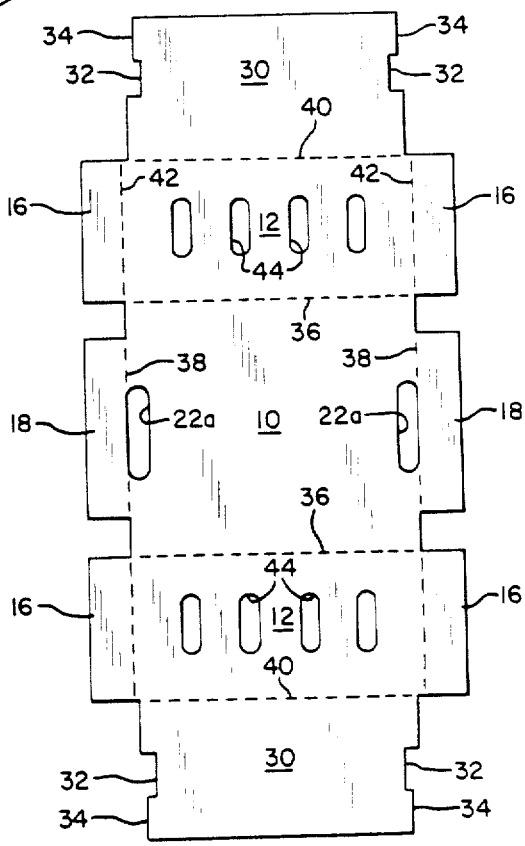
FIG. 3 is a plan view of a foldable container blank used to form the body and lid of the container, prior to folding and assembly.
Figure 4:
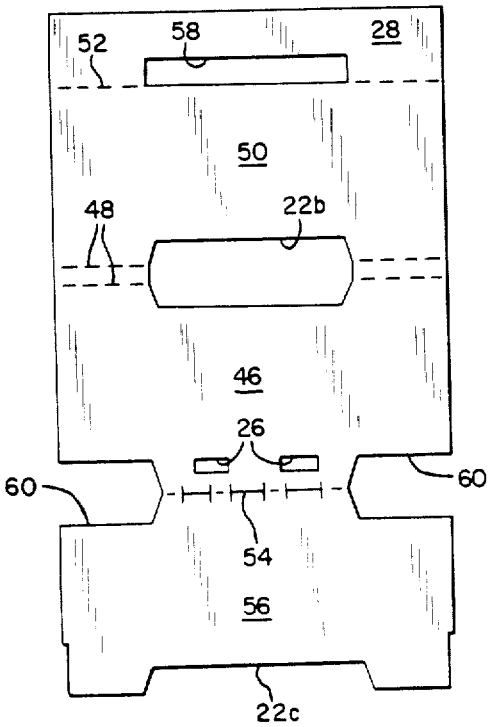
FIG. 4 is a plan view of an end wall blank used in conjunction with the blank of FIG. 3, prior to folding and assembly.

The manner of construction of the container is more fully apparent from a consideration of FIGS. 3, 4 and 5. FIGS. 3 and 4 illustrate the two blanks of which the container is made. FIG. 3 illustrates the container body and FIG. 4 a component thereof, i.e. a foldable container end wall center panel.

As depicted in FIG. 3, the body blank provides a bottom segment 10 connected by score lines 36 to side walls 12 and by score lines 38 to bottom flanges 18. Side walls 12 in turn are connected by means of score lines 40 to lids 30 and by score lines 42 to side flanges 16.

Bottom 10 also is provided with openings 22*a* which are components of stacking recesses 22 and which further serve a ventilating function.

Side walls 12 are provided with ventilating openings 44.

The blank of FIG. 4, which folds into center panel 20 comprises a central segment 46 connected through spaced score lines 48 to a second central segment 50 which in turn is connected through score lines 52 with segment 28 which forms the inwardly extending ledge.

Segment 46 also is connected through score line 54 with segment 56.

Segments 46, 50 are cut away to form a central opening 22*b* which forms part of the stacking recess.

Segment 28, which forms the inwardly extending ledge supporting the lids, is provided with an opening 58 which provides a relief dimensioned to accommodate a stacking cleat.

Segment 56 is provided on its outer margin with a cut-away portion 22*c* which cooperates with elements 22*a* and 22*b* in forming stacking recess 22.

The meeting margins of segments 46, 56 are cut away to form recesses 60 which define stacking cleat 24 when the segments are folded along score line 54.

The manner of assembly of the container is illustrated in FIG. 5.

The two component blanks are folded in the manner illustrated, and the blanks forming the end walls are glued to supporting flanges 16 and 18. This results in the formation of the assembled box of FIGS. 1 and 2.

Figure 2:
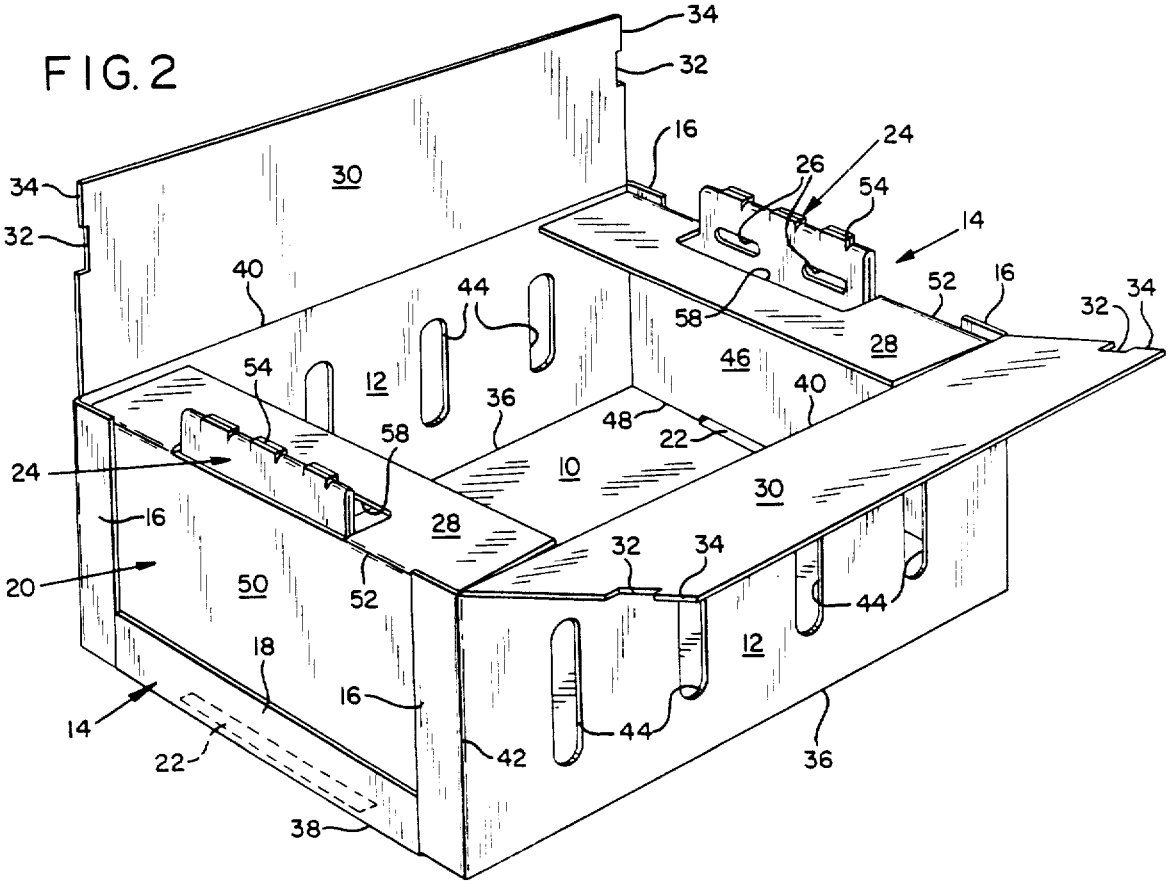
FIG. 2 is a perspective view of the container with lid in open, unlocked position.

The box is packed in the open condition of FIG. 2. When lids 30 are moved to the closed position of FIG. 1, the resiliently deformable material of which the lids are composed permits deformation of locking tongue extensions 34 until the lids are coplanar with locking recesses 26. When this position is attained, the tongues snap into the recesses, locking the lids in the closed position. This is accomplished easily without excessive deformation, and hence without delamination of the locking tongues.

When it is desired to open the box, upward pressure on lids 30 causes the locking tongues to pop out of the recesses in which they are contained. This again is accomplished easily and without excessive tongue deformation and wear. As a result, it is possible to open and close the lids over and over again as required for inspection, merchandising and storage without losing the efficiency of the lock.

Because of the unitary construction of stacking cleats 24, stacking and unstacking of the containers may be easily and rapidly accomplished without the necessity of exactly aligning spaced cleats and with a minimum of time and effort.

It is to be understood that the preferred embodiment of my invention described herein is illustrative only, and that modifications thereof are considered to be within the scope of the invention as defined by the appended claims. The terms "side walls and end walls", for example, are to be considered as relative only and may be employed interchangeably for the purposes of the invention.

I claim:

1. A stackable container for packaging and transporting fresh fruits, vegetables and the like, comprising (a) a body member having a generally rectangular vertical cross section and open at its opposite ends, said body member being formed from a unitary, generally rectangular blank of corrugated paperboard including (1) a generally rectangular bottom wall (10) having opposed side and end edges, said bottom wall end edges each containing an opening (22*a*), respectively;

(2) a pair of side walls (12) connected with said bottom wall side edges by a pair of first parallel fold lines (36), respectively, said side walls being folded about said first fold lines, respectively, to spaced parallel positions normal to said bottom wall; and (3) a pair of lid flaps (30) connected with the edges of said side walls opposite said bottom wall by a pair of second parallel fold lines (40), respectively, said lid flaps being adapted for folding about said second fold lines, respectively, to coplanar positions normal to said side walls spaced from and parallel to said bottom wall, thereby to define the top wall of the body member, said lid flaps each containing a cut-out portion (32) in each end edge thereof, said cut-out portions each defining a locking tongue extension (34);

(b) a pair of end walls (14) for closing the ends of said body member, each of said end walls being formed from a unitary, generally rectangular blank of corrugated paperboard, respectively, each of said blanks including (1) a generally rectangular intermediate section (56) having opposed side and end edges;

(2) a generally rectangular inner section (46) connected with one end edge of said intermediate section by first fold line means (54);

(3) a generally rectangular outer section (50) connected with the free end edge of said inner section by second fold line means (48) parallel to said first fold line means;

(4) a generally rectangular ledge section (28) connected with the free end edge of said outer section by third fold line means (52) parallel to said second fold line means;

(5) said intermediate and inner sections containing a pair of recesses (60) in their side edges, respectively, along said first fold line means to define a cleat bridging said intermediate and inner sections;

(6) said inner section containing a pair of spaced apertures (26) adjacent said first fold line means;

(7) at least one of said inner and outer sections containing a first aperture (22*b*) intermediate the side edges thereof along said second fold line means; and (8) said ledge section containing a second aperture (58) intermediate the side edges thereof along said third fold line means, said intermediate section being folded about said first fold line means to a position in contiguous engagement with said inner section, said inner section being folded about said second fold line means to a position parallel with said outer section, said intermediate section being sandwiched between said inner and outer sections to define a three-layer end wall with said cleat extending beyond the upper edge thereof; and (c) means connecting said end walls with said body member with said inner sections arranged facing one another and with said end wall first apertures being aligned with said body member bottom wall openings, respectively, said ledge sections being folded about said third fold line means over said cleats to positions parallel to and opposite said body member bottom wall and said body member lid flaps being folded about said second fold lines to positions adjacent said ledge sections with said lid locking tongue extensions engaging said end wall inner section apertures, respectively, to close and lock the container, whereby when the containers are stacked, said cleats of a lower container are received by said aligned end wall first apertures and said body member bottom wall openings of the upper container.

2. A container as defined in claim 1, wherein said connecting means include an adhesive.

3. A container as defined in claim 2, wherein said connecting means further include side flanges (16) connected with the end edges of said side walls by a pair of third fold lines (42) and a pair of bottom flanges (18) connected with the end edges of said bottom wall by said third fold lines.

* * * * *